United States Patent [19]

Massoud

[11] 4,418,027

[45] Nov. 29, 1983

[54] METHOD OF MOULDING A CERAMIC ARTICLE BY SLIP-CASTING

[75] Inventor: Ebrahim Massoud, Shelton, England

[73] Assignee: National Research Development Corporation, London, England

[21] Appl. No.: 368,964

[22] Filed: Apr. 16, 1982

Related U.S. Application Data

[63] Continuation of Ser. No. 187,446, Sep. 15, 1980, abandoned.

[30] Foreign Application Priority Data

Sep. 13, 1979 [GB] United Kingdom ..... 7931739
Jun. 18, 1980 [GB] United Kingdom ..... 8019913

[51] Int. Cl.[3] ..... B06B 1/02

[52] U.S. Cl. ..... 264/24; 204/181 F; 264/105

[58] Field of Search ..... 264/24, 86, 105; 204/181 F

[56] References Cited

U.S. PATENT DOCUMENTS 4,121,987 10/1978 Ryan ..... 204/181 F

*Primary Examiner*—Donald E. Czaja

*Assistant Examiner*—W. Thompson

*Attorney, Agent, or Firm*—Cushman, Darby & Cushman

[57] ABSTRACT

A ceramic article is electrophoretically slip-cast by placing an aqueous suspension of a ceramic material in a multi-part mould, each part of which has an electrically conductive porous carbonaceous operative surface conforming to the desired outside surface of a respective part of the article, the carbonaceous component of the surface region being made of particles of from 70 μm to 200 μm maximum diameter, the parts of the mould being electrically insulated from one another, each part being intermittently made anodic with respect to the suspension, at least one part at any time being cathodic (except for possible intervals when no part is anodic). Thus a model horse is made from the mould parts of FIG. 4 which are electrically charged in the following sequence, 1 minute each phase and all repeated at least once:

41 + − +
42 + + −
43 − + −
44 − + −
45 − + −
46 − + +

10 Claims, 4 Drawing Figures

Figure 3:
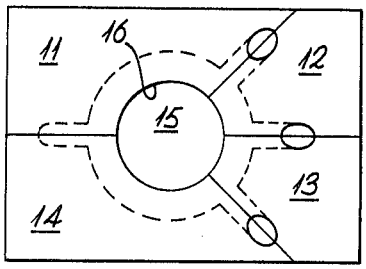

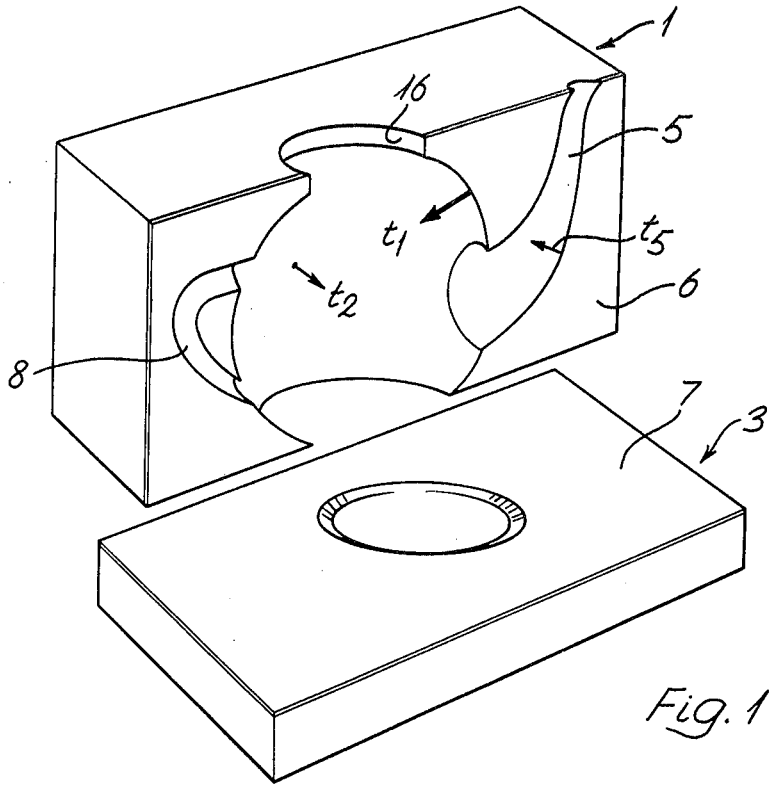
Fig. 1
Fig. 2
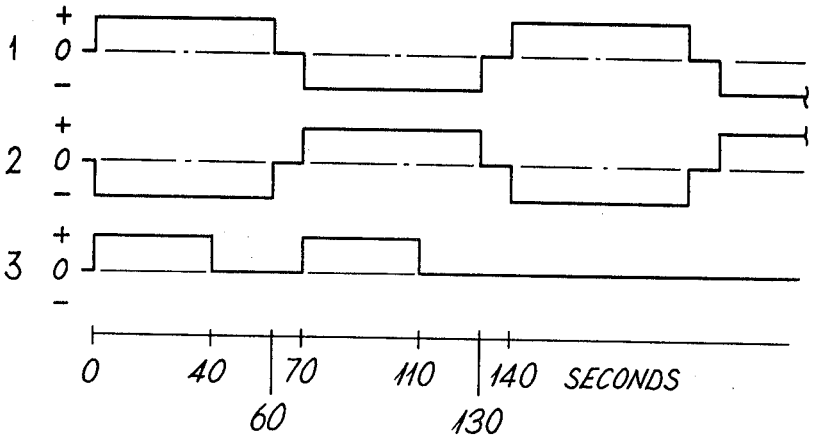

METHOD OF MOULDING A CERAMIC ARTICLE BY SLIP-CASTING

This is a continuation of application Ser. No. 187,446 filed Monday, Sept. 15, 1980, now abandoned.

This invention relates to a method of moulding a ceramic article by slip-casting.

In conventional slip-casting of ceramic articles, a suspension of ceramic material ('slip') is poured into a porous plaster of Paris mould, which by capillary action abstracts water from the slip, whereby the ceramic material builds up as a deposit on the mould; excess slip is poured away, and the built-up deposit is removed from the mould for firing.

This casting process is rather slow. Also, the rheological properties of the slip are critical, with minor variations in viscosity and thixotropy resulting in casting faults.

It has been proposed to assist the casting process by means of electrophoresis. Application of a direct current potential difference between two electrodes suitably placed, one in contact with the mould and the other in the slip contained in the mould, causes a migration of the solid particles suspended in the slip to the walls of the mould to form the cast. Unfortunately, however, this potential difference simultaneously electrolyses the water of the slip, and gas evolved at the electrode in contact with the mould spoils the surface of the cast. Nonetheless, electrophoretic slip casting is still desirable as it can speed up casting by a factor of 10 or more and does not require such close control of the rheological properties of the slip. Also, by replacing plaster of Paris moulds by stronger, conductive moulds, it allows mould life to be extended well beyond the 70 or so fillings which is typical of the life of a plaster mould used for conventional slip-casting.

U.S. Pat. No. 4,121,987 discloses a method of electrophoretically slip-casting an article. This method comprises placing an aqueous suspension of a ceramic material in a fired or cured mould having an electrically conductive porous carbonaceous operative surface conforming to the desired surface of the article. The carbonaceous component of the surface region (before firing or curing of the mould) has to be of particles of from 70 μm to 200 μm maximum diameter, allowing evolved gas to escape into the mould. In the method, the operative surface of the mould is electrically charged in the opposite sense to the charge carried by the material in the suspension, and this is followed by removing the remaining suspension after the material has built up to a desired thickness in the mould, and removing the material in the form of the desired article from the mould.

The charge carried by ceramic material in suspension is usually negative, but certain materials such as alumina are positively charged when in acid suspension. Thus although most ceramic materials will demand an anodic (positively charged) mould, alumina will require a cathodic mould, and hereafter when "anode" and "cathode" are mentioned, the reverse is intended in connection with positively charged materials.

In the method disclosed in that U.S. patent, a cathode is normally present immersed in the suspension, and may be of wire netting formed into a reduced-scale approximation of the desired interior shape of the (hollow) article and placed centrally in such shape. This cathode must be designed with care, as slight irregularities will lead to local variations in current density and hence to a spoiled article. Also, the need to remove the cathode from the interior of the article restricts the shapes which can be made by this method.

According to the present invention, a method of moulding a ceramic article by slip-casting comprises placing an aqueous suspension of a ceramic material in a multi-part mould, each part of which has an electrically conductive porous carbonaceous operative surface conforming to the desired outside surface of a respective part of the article, the carbonaceous component of the surface region being made of particles of from 70 μm to 200 μm maximum diameter, the parts of the mould being electrically insulated from one another, each part being intermittently made anodic with respect to the suspension, at least one part at any time being cathodic (except for possible intervals when no part is anodic). Preferably cathodicity is equally distributed among a plurality of the parts. In certain cases, one or some parts may be anodic, not intermittently but all the time, that is, they are never cathodic. Potentials of 50 V to 70 V with respect to the suspension are preferred.

Preferably the mould has a bottom part, and two side parts meeting on a parting plane, and optionally a top part. In such a case, the top and bottom parts can be anodic all the time (except when uncharged), while the two side parts are alternately anode/cathode and cathode/anode. The side parts are preferably uncharged for an interval before alternation. Alternations (charge reversals) preferably occur every 40 to 120 seconds, and there are preferably at least three of them for each part undergoing them, i.e. each part preferably is of each charge at least twice, to minimise the effect of starting first.

The top and bottom parts may, on the other hand, alternate in charge, with longer uncharged intervals before alternation than with the side parts, and they preferably stay uncharged from the last alternation(s) of the side parts.

A shape is suitable for slip-casting in such a three- or four-part mould if, neglecting opposite end regions thereof, an imaginary parting plane (which need not be flat, but which must not be re-entrant) can be constructed which divides the shape such that any point on the shape has a corresponding point on the opposite side of the parting plane, the points being connected by an imaginary straight line substantially bisected by the parting plane, the line not intersecting the shape at any other point. This more or less corresponds to what is suitable for making by conventional slip-casting in three- or four-part moulds, and includes for example spheres, teapots (complete with spout and handle), jugs, rectangular tanks and water closets. As conventionally, 'unsuitable' shapes (e.g. three-spouted teapot) may be made by adding by hand the necessary bits (extra spouts) to the closest convenient 'suitable' shape. Alternatively, the mould may be of as many parts as necessary to permit the desired article to be slip-cast 'in one'.

Preferably, the operative surface of the mould as pores of a maximum size of from 2 μm to 4 μm in diameter. Preferably the operative surface comprises cement (preferably 30–55%) and carbon (balance). More carbon gives better conductivity but less strength, and vice versa.

Preferably, in this case, the parts of the mould are made by centrifuging or pressing a cement/coke mixture (the coke preferably being petroleum coke and preferably amounting to 45–55% of the mixture) to the required form to an extent sufficient to yield the desired pore diameters, and leaving the parts to cure (either in air, or for example in steam for 3 hours). The parts may alternatively be made by casting, when the mixture may contain 55–65% carbon. The cement industry has ample practical knowledge of such methods, but this knowledge has not hitherto been at the disposal of the ceramics industry because the pore sizes of the resulting pressings or castings would have been unsuitable for conventional slip-casting.

In some cases, it is preferable to make the mould with a varying cement/carbon ratio, so as to vary the conductivity from one region to another, for reasons to be described.

Figure 4:
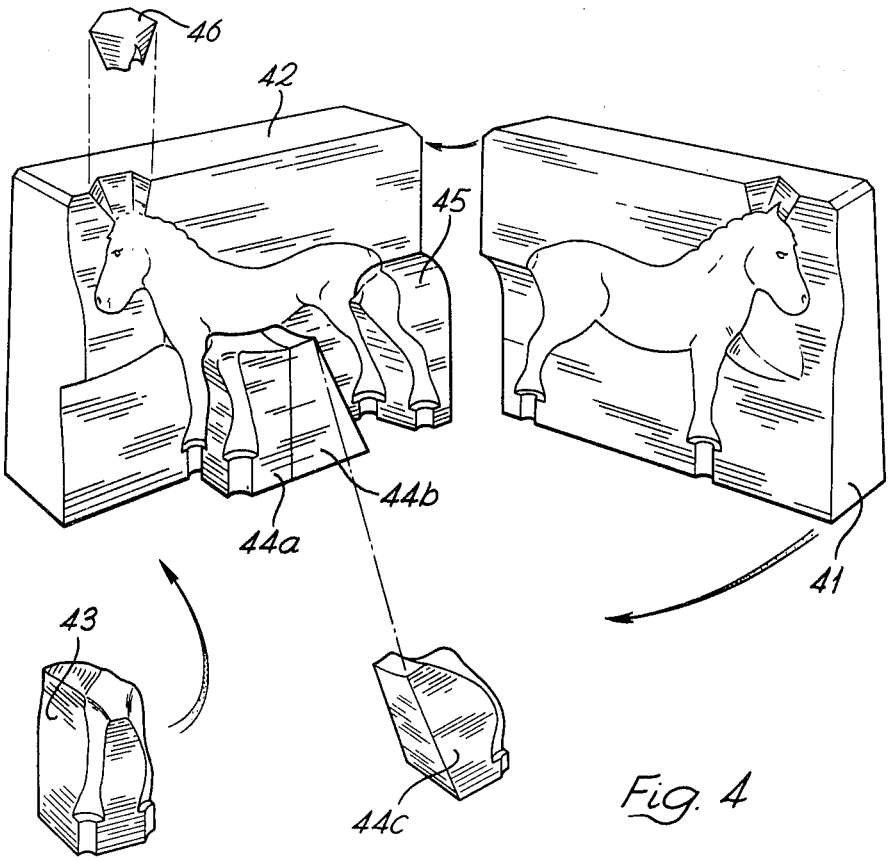

The invention will now be described by way of example, with reference to the accompanying drawings, of which FIG. 1 illustrates two parts of a 3-part teapot mould, FIG. 2 shows a charging schedule, FIG. 3 is a plan view of a mould for slip-casting a three-spouted teapot 'in one', and FIG. 4 is a partly exploded view of a multi-part mould for casting a model horse.

Referring to FIG. 1, a side part 1 and a base part 3 of a teapot mould are made by pressing 50% petroleum coke and 50% cement, the coke having a maximum particle size of 100 μm, until the surface has a maximum pore size of around 3 μm. The parts are cured by standing for 3 hours in a steam oven. After use, this material (which will have become wet) can be dried at 90° C. without cracking, thanks to its good thermal conductivity; plaster moulds should not be heated above 40° C., and thus take much longer to dry out for re-use.

A second side part (not shown, but for convenience designated 2), made identically, is a mirror-image of the side part 1.

In the spout region 5, directly opposite the handle region 8, the cement proportion is enhanced, to 55%, to make that region somewhat less conductive than the rest.

The mould parts 1, 2, 3 have respective electrical connection termini (not shown) placed, where possible, at the points on the outside of the mould nearest the points on the inside (operative surface) furthest from the other mould parts. Those faces (e.g. 6, 7) of the mould parts which will contact any other mould part in use are painted with an electrically insulating material such as a rubber solution to insulate each mould part electrically from the others.

The mould is assembled from the three parts 1, 2, 3 and an aqueous suspension of ceramic slip is poured in.

The three parts are now electrically charged according to the schedule shown in FIG. 2.

At the start, the mould parts 1 and 3 are made about 60 V to 70 V anodic with respect to the (negatively charged) suspension, and a deposit of ceramic material builds up electrophoretically (equivalent to a current of about 2 A to 3 A) on the shaped surfaces (operative surfaces) of those mould parts. Instead of an independent cathode, the mould part 2 does temporary duty as cathode, and for the moment no ceramic material deposits on it.

It will be appreciated that the voltage gradient set up between the side parts 1 and 2 is uneven because of the differing 'anode-cathode' spacings of different elements of the operative surfaces across the parting plane (the plane dividing the two side parts). Thus, a rapid deposition to thickness $t_1$ will occur near the parting plane in the same time as a lesser deposition to thickness $t_2$ at a far point on the equator of the nascent teapot, because the different anode-cathode distances at a fairly uniform voltage mean different voltage gradients, which mean different driving forces for the deposition.

After 40 seconds, the base part 3 is made uncharged. The side parts 1, 2 stay charged until 60 seconds in order to compensate for the more rapid deposition on the base part. This is a feature of the geometry of the teapot, and for some shapes it might be necessary to have the base part charged for longer than the side parts. Because of a drift set up in the suspension, deposition does not cease immediately, and to take advantage of this, every part is left uncharged for 10 seconds, until 70 seconds from the start.

Then the base part 3 is again made anodic, while the side parts 1, 2 reverse roles. (In the case of an object requiring also a top mould part, the base and top parts would also reverse roles at this juncture.) Because of the foregoing voltage gradient considerations, the thicker ($t_1$) deposit is removed electrophoretically at a higher rate than the thinner ($t_2$) deposit, in perfect compensation. Meanwhile, ceramic material is depositing on the mould part 2. The base part is made uncharged after a further 40 seconds (i.e. 110 seconds from the start) and the side parts after 60 seconds (i.e. 130 seconds from the start). After a 10 seconds' pause, the whole cycle is repeated at least once, except that the base part (and top part if present) no longer participate. By this time, the difference in thicknesses between the two sides of the teapot is relatively too small to matter, but if this point is important, the cycle can be repeated more often or more frequently, and/or including the base/top at a later stage, as found to be best by trial and error.

Because the spout region 5 of the mould was made less conductive, a smaller voltage gradient applied there, and the thickness $t_5$ of the deposit there was kept small enough to ensure that the spout stayed hollow. Meanwhile, the handle region 8, with no such adjustment of voltage gradient, deposited sufficiently to form a solid handle. However, with care in locating the electrical connection termini, local compositional (and hence conductivity) adjustments can be dispensed with.

The mould is upended to remove excess slip and is then dismantled, and the teapot is removed. The teapot is fettled (as conventionally) to smooth away the parting lines giving away the mould parts, and is dried, glazed and fired as conventionally.

The mould can thus produce a teapot every 3 minutes or so, and, being of relatively abrasion-resistant cement, should last to make at least a few hundred teapots.

Turning to FIG. 3, a mould for slip-casting a three-spouted teapot 'in one' according to the invention is seen in plan and has a base part 15 and four side parts 11, 12, 13, 14. The parting planes between the four side parts are shown in full lines. The three spouts are formed between the pairs of side parts 11/12, 12/13 and 13/14, while the handle is formed between the pair 11/14. The hole 16 for the lid is of the same diameter as the base. A possible charging schedule would be as follows:

| Mould Part | Charge | | | | | | |
|---|---|---|---|---|---|---|---|
| 11 | + | + | + | − | + | + | + |
| 12 | + | + | − | + | + | + | + |
| 13 | + | − | + | + | + | − | + |
| 14 | − | + | + | + | − | + | + |

-continued

| Mould Part | Charge | | | | | | |
|---|---|---|---|---|---|---|---|
| 15 | + | + | + | + | + | 0 | − |

Turning to FIG. 4, a mould for casting a model horse according to the invention is made from the same materials as the mould of FIG. 1, but in the proportions 55% coke+45% cement, and the parts are made by casting rather than by pressing. Those faces of the mould parts which will contact any other mould part in use are painted with insulating rubber solution. The operative faces of the mould parts, i.e. the faces on which slip-casting is to occur, remain conductive and, should they become somewhat decarbonised (and hence less conductive) after some use, they may be 'refreshed' by applying onto them a dry graphite lubricant coating in the form of a graphite suspension in PTFE in an ether/-petroleum aerosol propellant such as Unicorn Dry Film Lubricant by Unicorn Chemicals of Mowbray Drive, Blackpool, England. (Unicorn is a trade mark.)

The mould has a left flank part 41 and a right flank part 42. To reproduce leg detail, there fits between the parts 41 and 42 a chest part 43, front, middle and rear belly parts 44*a*, 44*b* and 44*c* and a buttock part 45. Finally, to reproduce ear detail, a poll part 46 also fits between the parts 41 and 42. The belly parts 44 are in three so that they can be disassembled, 44*b* first then 44*a* hindwardly and 44*c* forwardly, without disturbing the nascent casting; for the purpose of this invention, they can be treated as one and do not need to be insulated from each other by the rubber solution.

In use, the mould is assembled, strapped together and held inverted. The mould is filled through a leg with ceramic slip, taking care to expel all air from the mould. The mould parts are now electrically charged according to the following schedule, which is repeated at least once:

41: + − +
42: + + −
43: − + −
44: − + −
45: − + −
46: − + +

Each phase of this sequence lasts 1 minute, with a 10-second pause before the next phase, for sanitary ware or earthenware. For casting in bone china, fewer phases may be needed, perhaps as few as one positive and one negative for each part followed by a half-length phase of opposite sign (to only selected parts if appropriate) to compensate for casting thickness variations. Trial and error will reveal the best number and length of phases for any shape and ceramic material.

This sequence ensures that the body is cast thick enough and the legs thin enough for strength and lightness and to permit excess slip to be poured out at the end through the still-hollow legs.

I claim:

1. A method of moulding a ceramic article by electrophoretically slip-casting, the article having an inner and an outer surface, the method comprising:

(1) placing an aqueous suspension of a ceramic material in a mould having at least three mould parts, each part of which has an electrically conductive porous carbonaceous operative surface constituting the sole electrodes for the electrophoretic slip-casting, the operative surfaces conforming to said outer surfaces of a respective part of the article, the inner surface being undefined by the mould, the carbonaceous component of the surface region being made of particles of from 70 μm to 200 μm maximum diameter, the parts of the mould being electrically insulated from one another, and (2) intermittently electrically charging the operative surfaces of the mould independently making each part anodic with respect to said aqueous suspension, a plurality of the parts taking turns at being cathodic with respect to the suspension, each part of said plurality being cathodic and anodic at least twice each, at least one part at any time being cathodic except for possible intervals when no part is anodic and continuing the electrical charging until the ceramic material has built up to the desired thickness.

2. A method according to claim 1, wherein cathodicity is equally distributed among said plurality of the parts.

3. A method according to claim 1, wherein each of said plurality of parts is uncharged for an interval before a charge reversal.

4. A method according to claim 3, wherein each of said plurality of parts undergoes a charge reversal every 40 to 120 seconds.

5. A method according to claim 1, wherein one or some parts are never cathodic.

6. A method according to claim 1, wherein the cathodic and anodic potentials are from 50 V to 70 V with respect to the suspension.

7. A method according to claim 1, wherein the operative surface of the mould has pores of a maximum size of from 2 μm to 4 μm in diameter.

8. A method according to claim 1, wherein the operative surface of the mould comprises cement and carbon.

9. A method according to claim 8, wherein the cement is 30–55% and the carbon is 70–45%.

10. A method according to claim 9, wherein the parts of the mould are made by centrifuging, pressing or casting.

* * * * *